US005280459A

United States Patent [19]

Nakamura

[11] Patent Number: 5,280,459

[45] Date of Patent: Jan. 18, 1994

[54] ELECTRONIC TIMEPIECE

[75] Inventor: Chiaki Nakamura, Tokyo, Japan

[73] Assignee: Seiko Instruments Inc., Japan

[21] Appl. No.: 24,492

[22] Filed: Mar. 1, 1993

[30] Foreign Application Priority Data

Mar. 12, 1992 [JP] Japan ..... 4-53779

[51] Int. Cl.[5] ..... G04B 19/04; G04C 9/00

[52] U.S. Cl. ..... 368/80; 368/187; 368/204

[58] Field of Search ..... 368/10, 11, 76, 80, 368/107-113, 185-187, 203, 204, 223

[56] References Cited

U.S. PATENT DOCUMENTS

| | | | |
|---|---|---|---|
| 4,364,669 | 12/1982 | Thoenig et al. | 368/111 |
| 4,623,261 | 11/1986 | Muto | 368/80 |
| 4,694,410 | 9/1987 | Murata | 364/554 |
| 5,016,231 | 5/1991 | Kawaguchi et al. | 368/80 |

*Primary Examiner*—Vit W. Miska

*Attorney, Agent, or Firm*—Bruce L. Adams; Van C. Wilks

[57] ABSTRACT

An electronic timepiece which has storage means storing the positions of the pointers and controls the drive of the pointers.

A transfer means acts to transfer data between a first pointer position storage means and a second pointer position storage means. A drive-stopping means activates the transfer means. At this time, the transfer means transfers the positional data stored in the first pointer position storage means to the second pointer position storage means. If the output from a voltage comparator means indicates that the supply voltage exceeds a threshold voltage value set by a threshold voltage value-setting means, then a starting control means transfers the data stored in the second pointer position storage means to the first pointer position storage means.

8 Claims, 16 Drawing Sheets

ELECTRONIC TIMEPIECE

BACKGROUND OF THE INVENTION

The present invention relates to an electronic timepiece which has storage means storing the positions of the pointers and controls the drive of the pointers.

It is known that conventional electronic timepiece has means for storing the positions of pointers and means for providing control of the drive of the pointers and realize an electronic timepiece circuit system by a CPU core, a memory, and a peripheral pointer drive control circuit, as disclosed, for example in patent Laid-Open No. JP-A-77679/1990.

In these electronic timepieces, the presently displayed positions of the pointers used for display are stored in the storage means. The difference between the stored data about the presently displayed positions and the data about the positions to be displayed next is calculated. The pointers are driven according to the result of the calculation. This data about the displayed positions indicates positions relative to a reference position. Therefore, an initializing means for setting the reference position has been needed.

The pointer position storage means of the prior art electronic timepiece circuit system uses a static RAM as a data memory, the static RAM being a volatile memory. This static RAM is memory means adapted for electronic timepiece circuits, because the RAM and other circuit elements can be fabricated easily by the same process, and because the RAM consumes only a small amount of electric power.

However, this memory means has the disadvantage that it cannot retain data when the supply of electrical current is interrupted. As in the conventional instrument, even if data about the positions of the pointers are stored, data about the previous positions of the pointers are not stored when the electric battery is exchanged. Therefore, whenever such an exchange is executed, the initializing means must reset the reference position for the pointers.

When the battery is exchanged, the pointers display random positions. Much labor and long time are needed to drive the pointers by a switch means or the like in doing after-sale service.

SUMMARY OF THE INVENTION

Accordingly, it is a first object of the present invention to provide an electronic timepiece which uses a conventional memory means and is capable of easily initializing the positions of the pointers when the battery is replaced.

It is a second object of the invention to provide an electronic timepiece which stores the positions of the points in a nonvolatile memory, thus dispensing with the initializing operation for the positions of the pointers which would have been heretofore needed when the battery is replaced.

The above object is achieved in accordance with the teachings of the invention by a first structure comprising a pointer position-calculating means which is set into operation by the output from a voltage comparator means together with a correcting drive control means. The voltage comparator means compares a threshold voltage value set by a threshold voltage value-setting means with a supply voltage. The pointer position-calculating means compares the contents of a pointer position storage means with initial positions that form bases of the positions of the pointers. The correcting drive control means supplies driving pulses to pointer drive means according to the results of the calculatings.

In addition to this structure, a life display operation control means, a polarity discrimination means, and a polarity storage means are provided. Before, the correcting drive control means is operated, the life display operation control means activates the pointer drive means to cause the pointers to provide a display of warning of the life. The polarity discrimination means judges the polarity of the rotor magnet of a two-pole stepping motor when the circuit is set into operation after the battery is exchanged. The polarity storage means stores the result of the judgment and sets the direction of the output pulses from a motor driver for driving the motor.

The above object is also achieved in accordance with the teachings of the invention by a second structure comprising a pointer position storage means consisting of a nonvolatile memory and a drive-stopping means which is set into operation by the output from a voltage comparison means and causes the pointer drive means to stop the supply of driving pulses.

The above object is also achieved in accordance with the teachings of the invention by a third structure comprising: a first pointer position storage means consisting of a volatile memory; a second pointer position storage means consisting of a nonvolatile memory; a transfer means which transfers the stored data from the first pointer position storage means to the second pointer position storage means in response to the drive-stopping means; and a starting control means which is set into operation by the output from the voltage comparator means, activates the transfer means, and transfers the stored data from the second pointer position storage means back the first pointer position storage means.

In the electronic timepiece of the above-described first structure, the correcting drive control means is set into operation by the output from the voltage comparator means. The pointers are stopped at initial positions which form bases of the positions of the pointers. When the lifetime of the battery expires, the operation of the circuit stops. When the timer operation is restarted after exchange of the battery, the pointers are placed in the initial positions by the operations described above. Therefore, if the polarity of the rotor magnet of the stepping motor is coincident with the direction of the output from the motor driver, deviation from the reference position can be prevented. If they are not coincident, the deviation can be suppressed to an amount corresponding to 2 pulses.

In addition to this structure, a threshold voltage means into which a plurality of threshold voltages can be set and a life display operation control means can be provided. The life display operation control means starts a life display operation according to the result of a comparison with a first threshold voltage made by the voltage comparator means. Before the correcting drive control means is set into operation, the life display operation control means can warn that the lifetime has expired. Furthermore, deviation from the reference position can be prevented by providing a polarity discrimination means that judges the polarity of the rotor magnet of the two-pole stepping motor when the circuit is set into operation and another polarity discrimination means which stores the result of the judgment and activates the timer control means.

The electronic timepiece of the second structure described above can have a drive-stopping means which is set into operation by the output from the voltage comparator means and stops the supply of the driving pulses to thereby prevent the pointer position storage means consisting of a nonvolatile memory or the two-pole stepping motor from malfunctioning. Hence, correct data about the positions of the pointers can be stored.

In the electronic timepiece of the third structure describe above, the transfer means is set into operation according to the output from the drive-stopping means and the output from the starting control means. Data can be transferred between the first pointer position storage means consisting of a volatile memory and the second pointer position storage means consisting of a nonvolatile memory. In normal operation, the first pointer position storage means which consumes a less amount of electric power stores the data about the positions of the pointers. When the drive operation is stopped, the second pointer position storage means can store the data about the positions of the pointers. Consequently, it is not necessary that the second pointer position storage means consuming a relatively large amount of electric power be used frequently. In this way, low power consumption can be accomplished.

DETAILED DESCRIPTION OF THE PREFERRED EMBODIMENTS

Figure 1:
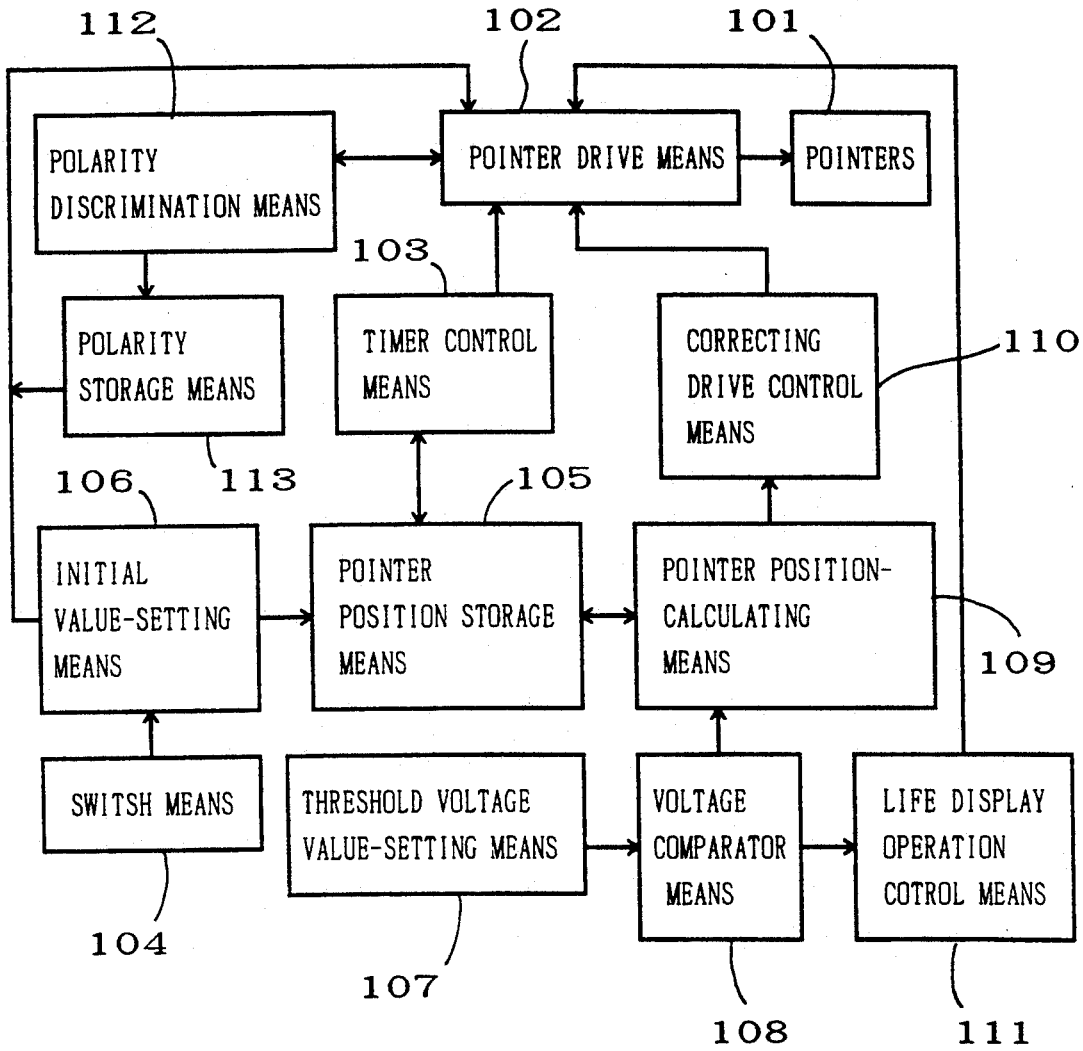
FIG. 1 is a functional block diagram of the pointer drive circuit of a first embodiment of the electronic timepiece according to the present invention.

Embodiments of the invention are hereinafter described by referring to the drawings.

FIG. 1 is a functional block diagram of the pointer drive circuit of a first embodiment of the electronic timepiece according to the invention. Pointers, indicated by 101, represent the second hand, the minute hand, the hour hand, etc. appearing on the dial of the timepiece. The pointers 101 are driven via a gear train (not shown) by a pointer drive means 102 including a stepping motor driver and a driving pulse-generating circuit.

A timer control means 103 performs time-counting processing of the timepiece, corrects the contents of data stored in a pointer position storage means 105, and delivers driving signals to a pointer drive means 102.

A pointer position storage means 105 stores data about the positions of the pointers 101 presently displayed, data about the time counted by the timepiece, data about the set alarm time, and other data. The stored data can take the form of positional data or ordinary data about time. All the data about the positions are stored as data regarding the positions from the position initialized by an initial value-setting means 106.

The initial value-setting means 106 is set into operation according to the output from a switch means 104 and activates the pointer drive means 102 to move the pointers 101 to the reference position on the dial. Data about the positions assumed when the movement is complete is stored as initial values in the pointer position storage means 105.

A threshold voltage value-setting means 107 produces a signal whose output level varies with variations in a supply voltage. A voltage comparator means 108 comparator means 108 compares the output signal from the setting means 107 with a reference voltage and produces a signal indicating whether the supply voltage is below a certain threshold voltage.

A pointer position-calculating means 109 is set into operation by the output from the voltage comparator means 108. The calculating means 109 calculates the difference (i.e., the amount of movement) between the data about the presently displayed positions of the pointers 101 stored in the pointer position storage means 105 and the data about the initial positions set by the initial value-setting means 106.

A correcting drive control means 110 causes the pointer drive means 102 to produce driving pulses according to the difference calculated by the pointer position-calculating means 109, for shifting the pointers 101 into the given reference position.

The threshold value is required to be set by the threshold voltage value-setting means 107 in such a manner that the supply voltage which is an inversion of the output from the voltage comparator means 108 is slightly higher than the minimum possible voltage at which the components of the electronic timepiece such as an electronic circuit, the stepping motor, and a loudspeaker are operated. This makes it possible to move the pointers 101 to the reference position slightly before the life of the battery expires.

Two kinds of threshold values are set into the threshold voltage value-setting means 107. That is, it produces two kinds of signals whose output levels vary with variations in the supply voltage. The voltage comparator means 108 compares its input voltage with two supply voltage.

When the supply voltage reaches a first threshold voltage set by the threshold voltage value-setting means 107, a life display operation control means 111 is set into operation. The pointer drive means 102 is operated to deliver driving pulses different from driving pulse used to provide a normal display of time.

If the supply voltage drops subsequently and reaches a second threshold voltage value set by the threshold voltage value-setting means 107, the pointer position-calculating means 109 is operated. As a result, the pointers 101 can be moved into the reference position. By this operation, the pointers 101 are not immediately stopped at the reference position; rather the pointers 101 can be brought to a stop after a warning of the expiration of the life of the battery is displayed. A polarity discrimination means 112 and a polarity storage means 113 are added to this structure. The polarity discrimination means 112 operates the pointer drive means 102 and judges the polarity of the rotor magnet of the two-pole stepping motor according to its output signal.

The polarity storage means 113 stores the result of the judgment. If the polarities do not agree, one motor driver is caused to produce correcting driving pulses.

The addition of these two structures makes it possible to bring the polarity of the rotor magnet of the two-pole stepping motor into agreement with the direction of the output from the motor driver when the power supply is again turned on.

Figure 2:
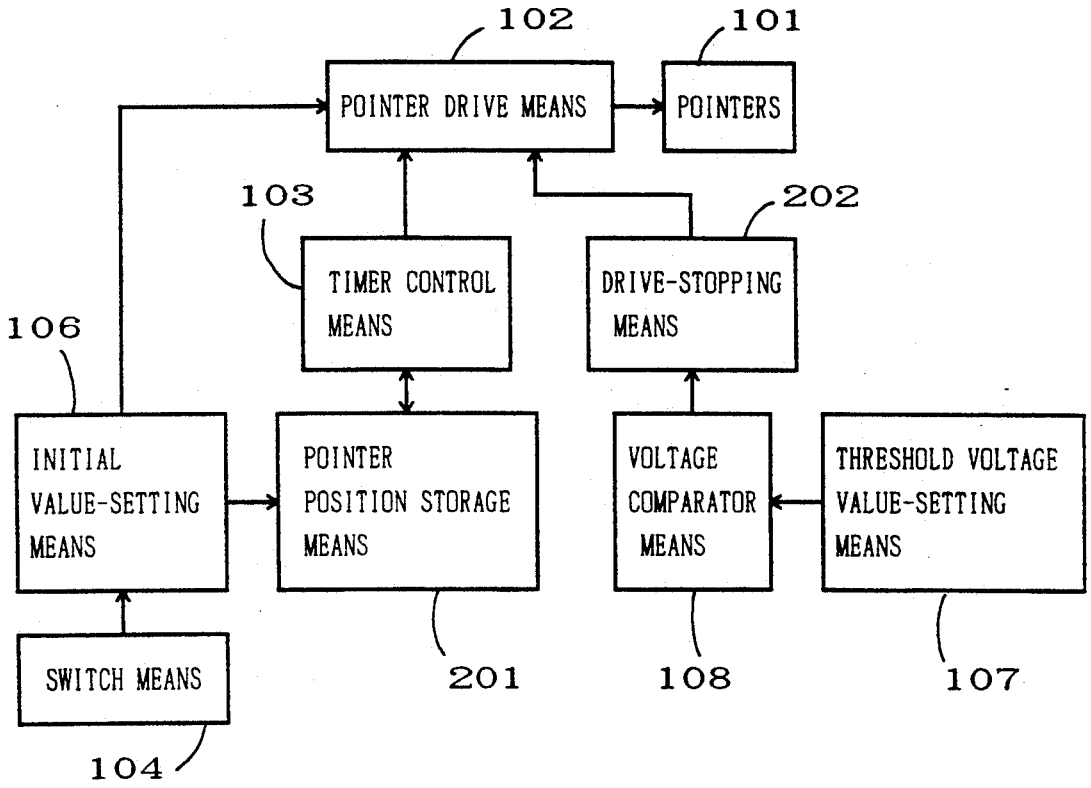
FIG. 2 is a functional block diagram of the pointer drive circuit of a second embodiment of the electronic timepiece according to the present invention.

FIG. 2 is a functional block diagram of the pointer drive circuit of a second embodiment of the electronic timepiece according to the present invention. A pointer position storage means 201 serves to store data about the positions of the pointers, in the same way as the pointer position storage means 105 of the functional block diagram of the aforementioned first pointer drive circuit. The pointer position storage means 201 consists of a nonvolatile memory such as an EEPROM. A drive-stopping means 202 starts its operation according to the result of the comparison made by the voltage comparator means 108, and stops the pointer drive means 102 from producing the driving pulses.

The threshold voltage for the threshold voltage value means 107 is set slightly higher than the minimum possible voltage at which the electronic circuit, the EEPROM, and the stepping motor are operated. In this way, the display operation is stopped before the electronic circuit, the EEPROM, or the stepping motor malfunctions. This assures that data about the correct positions of the pointers are stored in the pointer position storage means 201.

Figure 3:
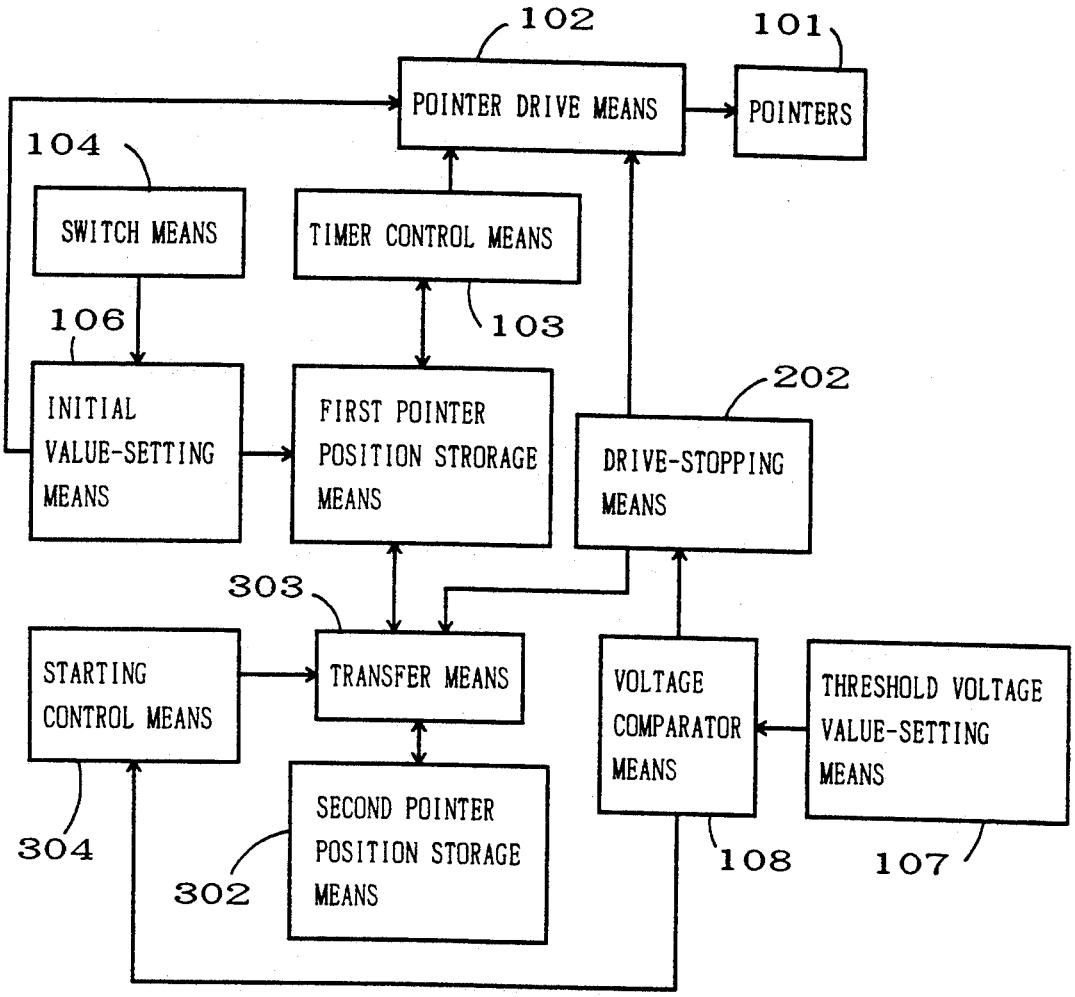
FIG. 3 is a functional block diagram of the pointer drive circuit of a third embodiment of the electronic timepiece according to the present invention.

FIG. 3 is a functional block diagram of the pointer drive circuit of a third embodiment of the electronic timepiece according to the invention. A first pointer position storage means 301 stores data about the positions of the pointers, in the same way as the pointer position storage means 201. The first pointer position storage means 301 consists of volatile memory such as an ordinary static RAM.

On the other hand, a second pointer position storage means 302 consists of a nonvolatile memory such as an EEPROM in the same way as the pointer position storage means 201. A transfer means 303 acts to transfer stored data between the first pointer position storage means 301 and the second pointer position storage means 302. The drive-stopping means 202 performs the above-described operation and operates the transfer means 303. At this time, the transfer means 303 transfers data about the positions, including the data about the presently display positions, stored in the first pointer position storage means 301 to the second pointer position storage means 302.

A starting control means 304 senses application of a voltage simultaneously with the insertion of a battery. If the output from the voltage comparator means 108 indicates that the supply voltage exceeds the threshold value set by the threshold voltage value-setting means 107, the control means 304 transfers data stored in the second pointer position storage means 302 to the first pointer position storage means 301. These operations make it unnecessary to frequently use a nonvolatile memory consuming a relatively large amount of electric power. During normal timer operation, data about the positions of the pointers are stored in the first pointer position storage means 301 and so the electric power consumed can be saved compared with the pointer drive circuit shown in FIG. 2.

Figure 4:
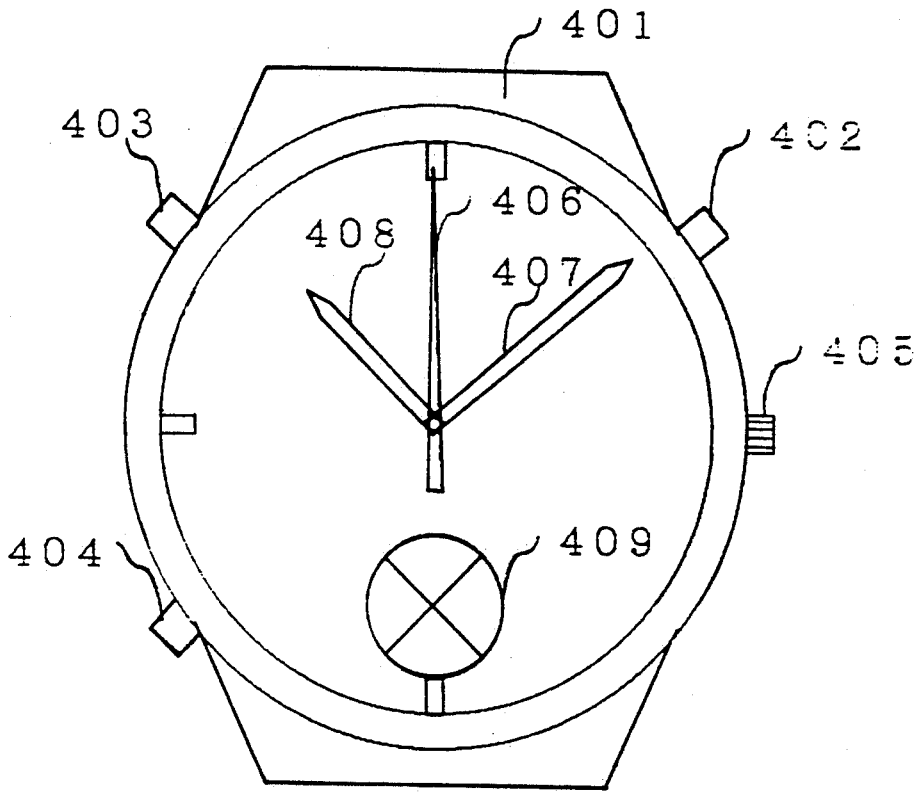
FIG. 4 is a perspective view of an electronic timepiece according to the invention.

FIG. 4 is a perspective view of an electronic timepiece according to the invention.

Pointers 406, 407, and 408 mounted on a dial 410 indicate a second hand, a minute hand, and an hour hand, respectively. These pointers are driven by their respective stepping motors. Side switches 402, 403, and 404 are activated in response to the operation of the pointers 406, 407, and 408. A mode display plate 409 is rotated by rotating a winding crown switch 405 and thus various modes can be set. Examples of specific circuits for realizing this electronic timepiece are described next.

Figure 5:
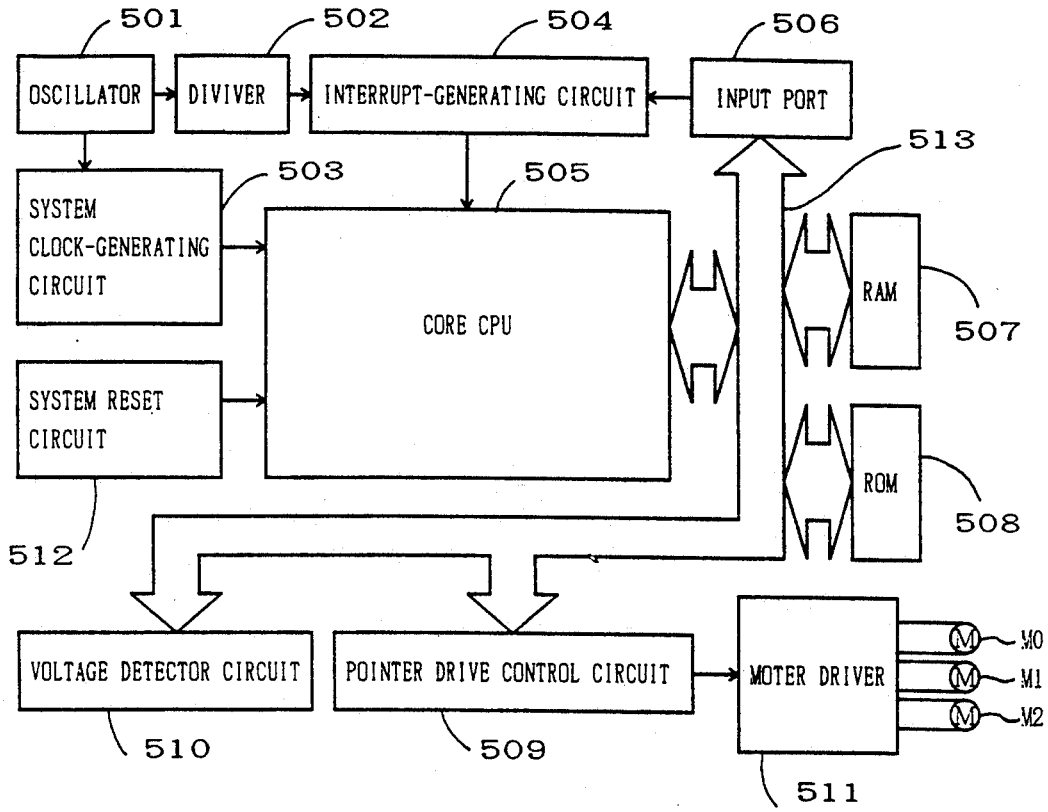
FIG. 5 is a block diagram of the system of an electronic timepiece, including the pointer drive circuit of the first embodiment of the invention.

FIG. 5 is a block diagram of the system of the electronic timepiece of the first embodiment of the invention, including the functions of the pointer drive circuit. The output signal from an oscillator 501 is applied to a divider 502. This divider 502 produces plural timing signals to an interrupt-generating circuit 504.

The interrupt-generating circuit 504 receives the timing signals and the output signal from an input port 506. The interrupt-generating circuit 504 produces an interrupt signal to a core CPU 505. In response to this interrupt signal, the core CPU accepts the system clock signal from a system clock-generating circuit 503 and runs a program loaded in a ROM 508.

For example, during the timer operation of the timepiece, a pointer drive control circuit 509 and a voltage detector circuit 510 are operated in accordance with the processing procedure of this program. In this way, stepping motors M0, M1, and M2 connected with a motor driver 511 are operated. Data about the positions presently displayed by the pointers 406, 407, and 408 shown in FIG. 4, data about the counted time, and other data are stored in a RAM 507. This is also operated in accordance with the procedure of the program.

A system reset circuit 512 initializes the core CPU. By this operation, the initializing processing stored in the ROM 508 is performed.

Figure 6:
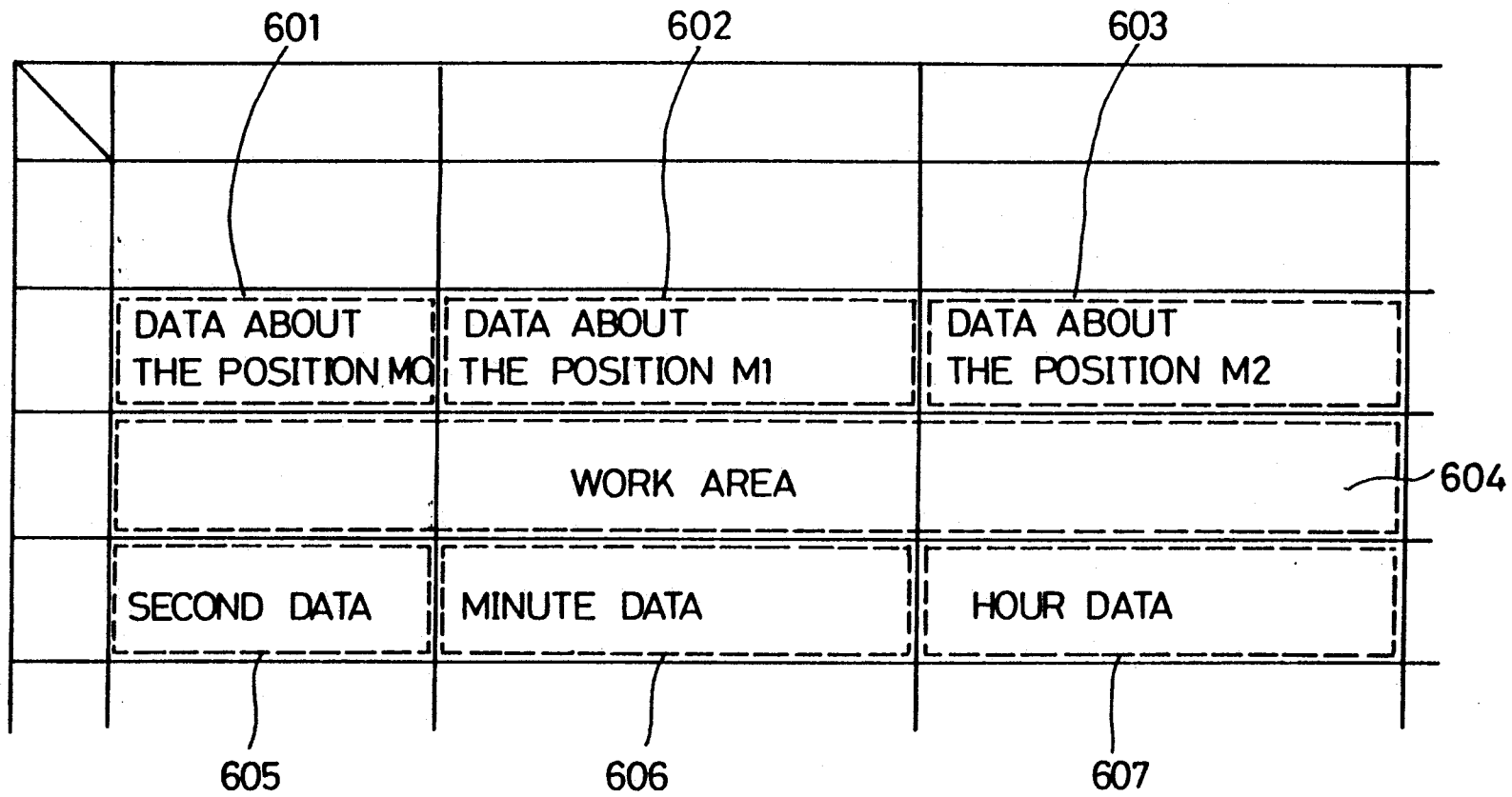
FIG. 6 is a diagram showing the manner in which data is assigned inside a RAM included in an electronic timepiece according to the invention.

FIG. 6 shows how data is assigned inside the RAM 507. Data 601 about the position M0, data 602 about the position M1, and data 603 about the position M2 indicate the positions presently displayed by the pointers 406, 407, 408, respectively. Second data 605, minute data 606, and hour data 607 are stored as data about the counted time of the timepiece. "WORK AREA" 604 is assigned as a location used by various kinds of data for calculations.

Figure 8:
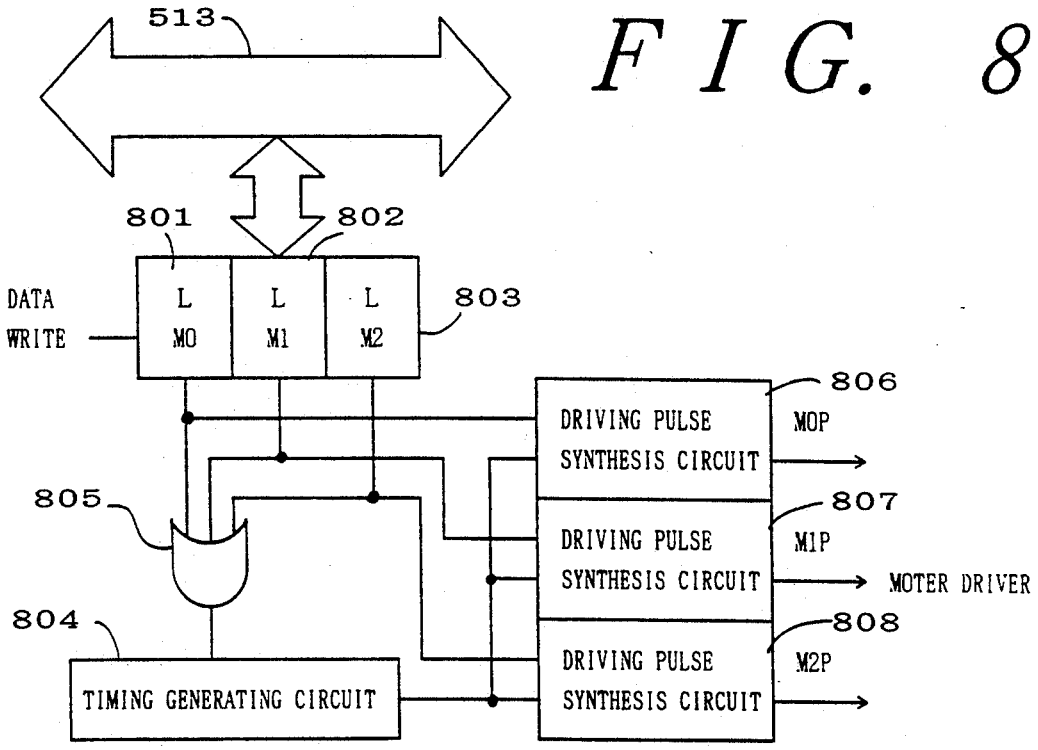
FIG. 8 is a diagram showing the structure of a pointer drive control circuit according to the invention.

FIG. 8 shows a specific example of the pointer drive control circuit 509. Registers 801, 802, and 803 correspond to the motors M0, M1, and M2, respectively, and store data for producing driving pulses to the motors. When "1" is set in any one of the registers, a timing-generating circuit 804 is operated, and driving pulse synthesis circuits 806, 807, 808 corresponding to the motors, respectively, are operated. As a result, driving pulses are produced to the motor driver.

Figure 7:
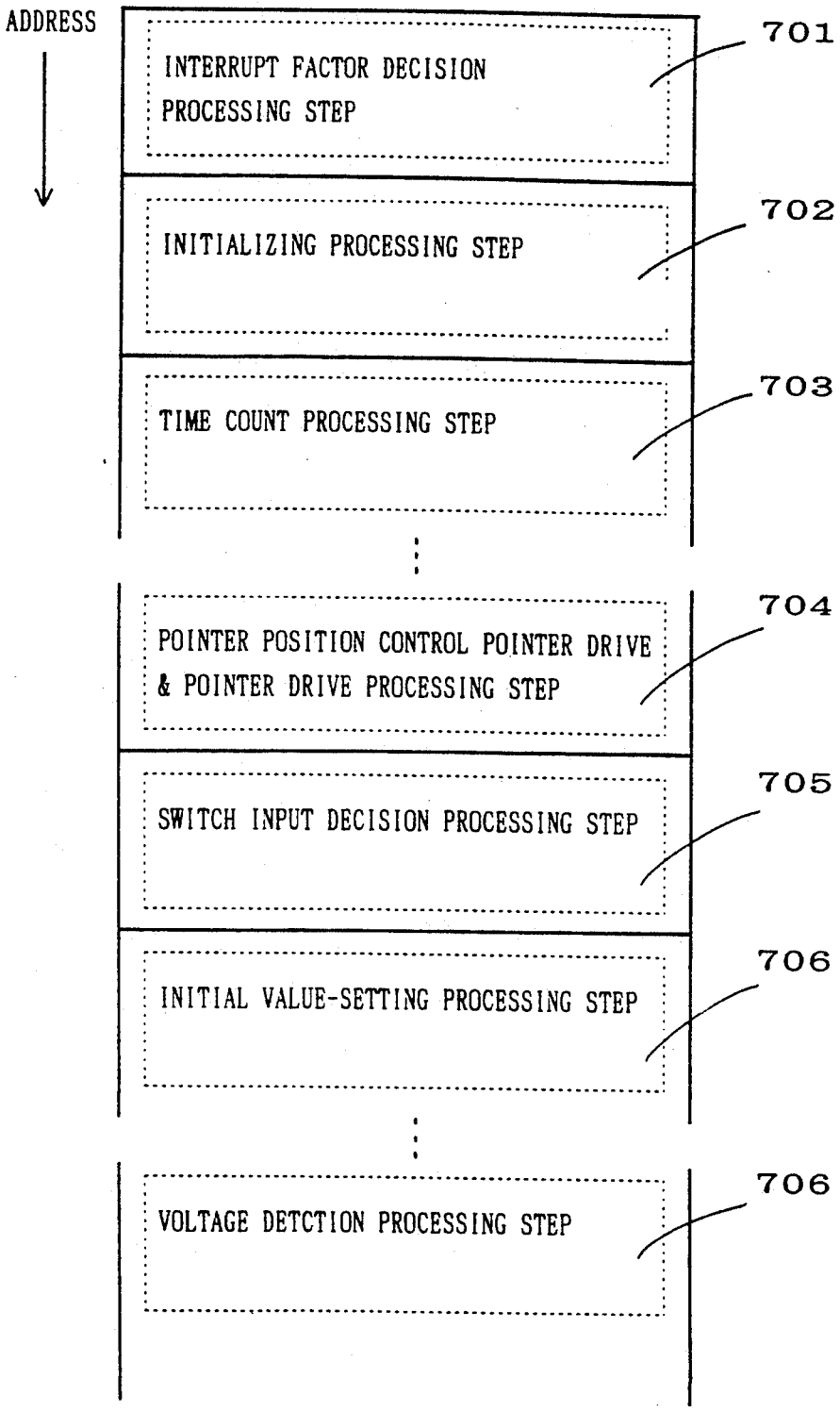
FIG. 7 is a diagram illustrating processing performed under a program loaded in a ROM included in an electronic timepiece according to the invention.

FIG. 7 illustrates the steps of processing performed under the program loaded in the ROM 508. In an interrupt factor decision processing step 701, an interrupt signal factor delivered from the interrupt-generating circuit 504 is judged. Then, control branches into various interrupt processing steps. In an initializing processing step 702, the peripheral circuit is initialized. If the mode is the initial value-setting mode, control goes to an initial value-setting processing step 706.

In a time count processing step 703, data are added to the second data 605, to the minute data 606, and to the hour data 607 in the RAM 507.

In a pointer position control & pointer drive processing step 704, calculations are performed to see if there is any difference between the data 601, 602, 603 about the displayed positions of the motors and the counted data in the displayed mode. If any difference is produced, "1" is written to driver registers 801, 802, 803 for the motors, respectively. Driving pulses are kept produced until the difference is reduced down to zero. The timer control means that constitutes one component of the present invention is realized in this way.

In a switch input decision processing step 705, a decision is made to see which of the switch inputs has occurred. Than, various switch input processing steps are performed.

In an initial value-setting processing step 706, if an input is applied to the switches 402, 403, or 404, then "1" is written to the driver registers 801, 802, or 803 for the motors, and driving pulses are produced. In this way, the pointers 406, 407, and 408 are moved to the reference position on the dial. The data about the positions assumed when the movement is complete is taken as 0. This data is stored in the data 601, 602, 603 about the presently displayed positions for the motors. In this manner, the initial value-setting means 106 forming a component of the present invention can be realized.

In a voltage detection processing step 707, the voltage detector circuit 510 is operated to provide a display according to the voltage value.

Figure 9:
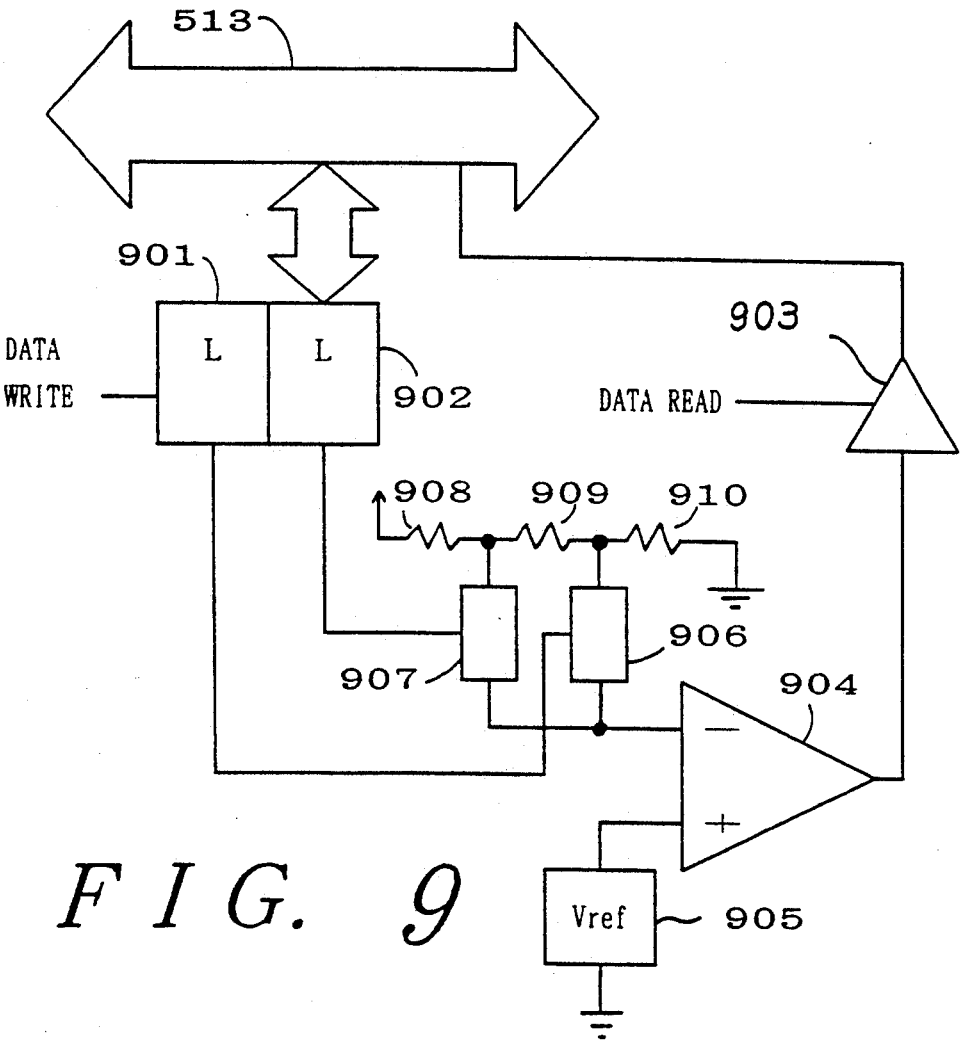
FIG. 9 is a diagram showing the structure of a voltage detector circuit according to the invention.

FIG. 9 shows a specific example of this voltage detector circuit 510. Analog switches 906 and 907 are activated according to the values in threshold voltage value-setting registers 901 and 902. The division ratios of resistors 908, 909, 910 are varied by this operation. A voltage level divided in this way is applied to a comparator 904. A reference voltage 905 is applied to one input of the comparator. The result of the comparison appears on a data bus 513 via a 3-state gate 903. The threshold voltage value-setting means 107 and the voltage comparator means 108 can be realized in this way.

The operation of the pointer position-calculation means 109, the drive-correcting means 110, and the life display operation control means 111 is next described.

Figure 13:
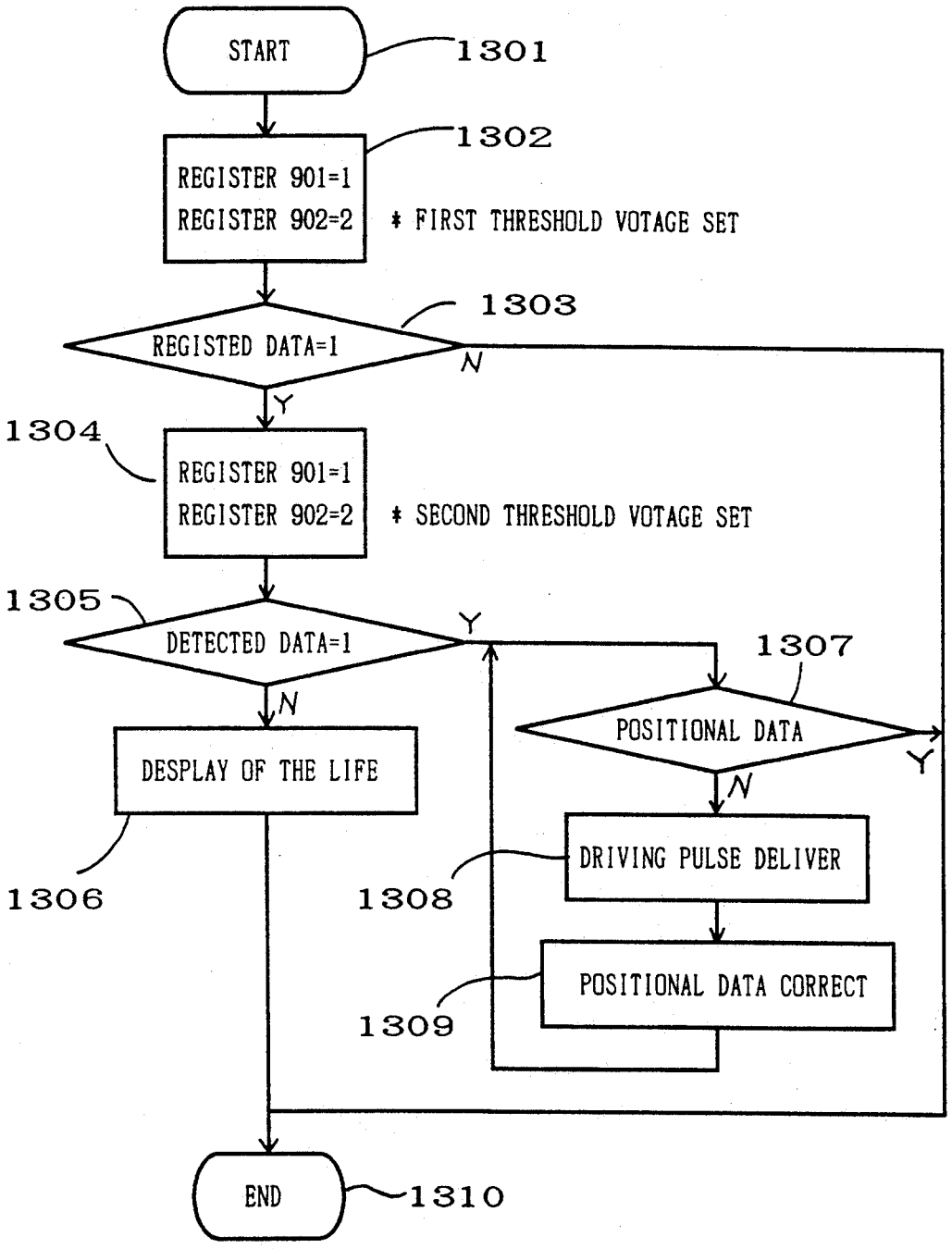
FIG. 13 is a flowchart illustrating the operations of a pointer position-calculating means, a correcting drive means, and a life display operation control means according to the invention.

FIG. 13 is a flowchart illustrating the operation performed by the pointer position-calculating means, the correcting drive means, and the life display operation control means according to the invention.

First, data are set in the threshold voltage value-setting registers 901 and 902. A first threshold voltage is applied to the comparator 904. If the result of the detection is 0, it follows that the supply voltage is sufficiently high and in normal condition. The following operations are not carried out (steps 1301–1303, 1310).

If the result of the detection is 1, then it follows that the voltage is below at least the first threshold voltage. Data are entered into the threshold voltage value-setting registers 901 and 902. The second threshold voltage is permitted to be applied to the comparator 904. If the result of this detection is 0, a life display operation is executed (steps 1301–1306, 1310).

The display of the life is provided by producing driving pulses different from normal driving pulses. For example, where the pointer 406 corresponding to the second hand is driven at intervals of 1 second during normal display, the display of the life is provided at intervals of 2 seconds with two pulses. This operation gives the user a warning.

If the result of the detection made in step 1305 is 1, then it follows that the voltage is still below the second threshold voltage. Then, calculations are performed to see if the values of the data 601, 602, 603 about the presently displayed positions of the motors are 0 or not. If not 0, the pointer drive control circuit 509 is operated, and driving pulses are delivered. Each time a driving pulse is produced, the positional data 601, 602, 603 are corrected. These operations are repeated until all the positional data 601, 602, 603 are reduced down to zero (steps 1307–1310).

By these operations (steps 1301–1310), the pointers 406, 407, and 408 are moved into the reference position set by the initial value-setting processing step 706.

Examples of the polarity discrimination means 112 for the rotor magnet of the two-pole stepping motor and of the polarity storage means 113 are described next.

Figure 10:
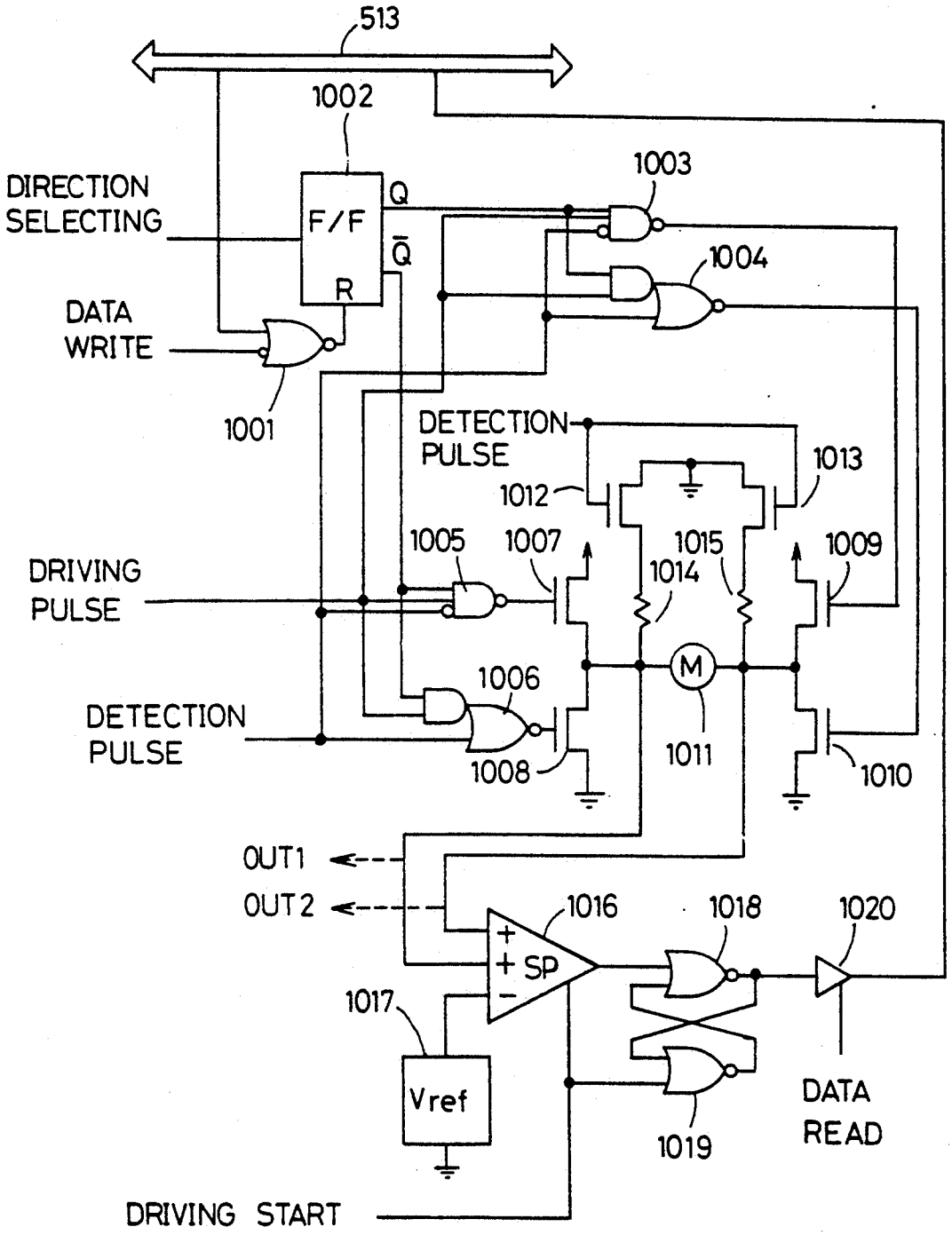
FIG. 10 is a diagram showing the structures of motor drivers and of a polarity discrimination circuit according to the invention.

FIG. 10 shows specific examples of the polarity discrimination means 112 and of the polarity storage means 113.

Normally, drive direction-selecting circuit 1002 is controlled by a direction-selecting signal. The output is also controlled by the data bus 513 and by a gate circuit 1001.

In response to the output from the drive direction-selecting circuit 1002, driving pulses are produced from the motor driver 1007, 1008, 1009, or 1010 via gate circuits 1003, 1004, 1005, and 1006, thereby driving a two-pole stepping motor 1011.

After the driving pulses are produced, a detection pulse 1 is applied to the gate circuits 1003, 1004, 1005, and 1006. At the same time, a detection pulse 2 is applied to transistors 1012 and 1013. The induced voltage are detected in the manner described now. The transistors 1012 and 1013 are biased into conduction. Under this condition, motor drivers 1007, 1008, 1009, and 1010 are turned on and off by the detection pulse 1. Finally, the voltages induced in resistors 1014 and 1015 are detected.

A comparator 1016 is set into operation by a drive starting signal. A voltage induced in the two-pole stepping motor 1011 is applied to this comparator, which compares this voltage with a reference voltage 1017. Then, the operation ends.

The result of the detection is stored in latch circuits 1018 and 1019. The contents of these latch circuits are produced to the data bus 513 via a 3-state gate 1020.

Figure 14:
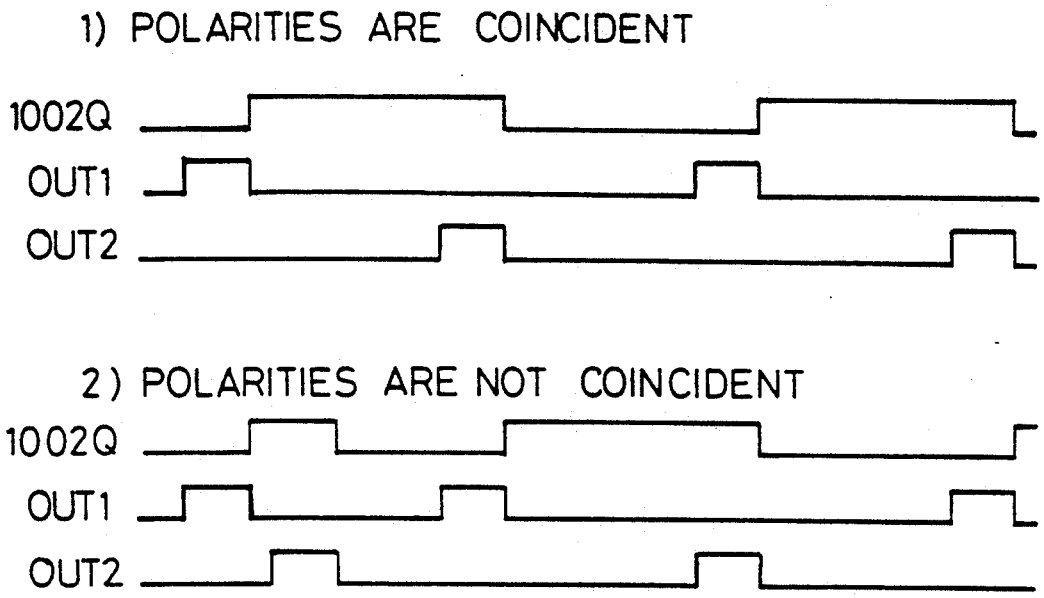
FIG. 14 is a timing chart illustrating the operation performed to judge polarities in accordance with the invention.

FIG. 14 is a timing chart illustrating a series of operations performed to judge the polarity.

The operation for judging the polarity of the two-pole stepping motor 1011 is carried out in the initializing processing step 702 within the ROM 508 when the power is turned on.

First, the Q output of the drive direction-selecting circuit 1002 is set to 0. At first, driving pulses are produced from the motor drivers 1007 and 1008 (on the side of OUT1). Then, the aforementioned detection of the included voltage is done. If the result of the 3-state gate 1020 indicated detection of rotation, then the polarities are judged to be coincident. In this case, driving pulses may be produced alternately at the next normal output intervals.

If the result of the 3-state gate 1020 does not indicate rotation, then the polarities are judged to be dissimilar. In this case, driving pulses are again delivered from one of the motor drivers 1009 and 1010 (on the side of OUT2). Then, driving pulses are produced alternately at normal output intervals.

This operation for judging the polarities may be carried out once in the initializing processing step 702 for each motor.

Figure 11:
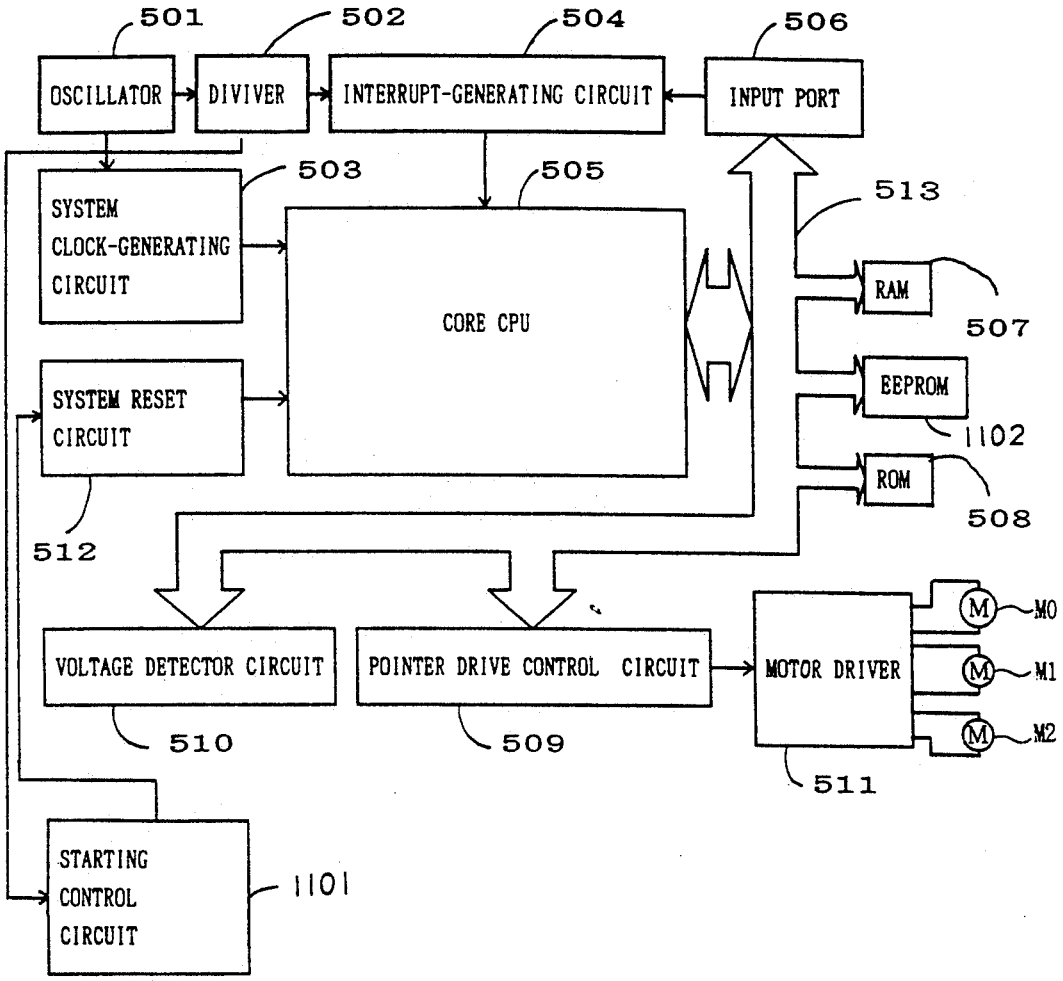
FIG. 11 is a block diagram of the system of an electronic timepiece, including the functions of the pointer drive circuits of second and third embodiments of the invention.

FIG. 11 is a system block diagram of an electronic timepiece according to the invention, including the functions of the pointer drive circuits of the second and third embodiments.

This is different from the system block diagram of FIG. 5 in the following respects. A RAM 507 that is a volatile memory and an EEPROM 1102 that is a nonvolatile memory are provided as data storage means. A starting control circuit 1101 is provided. Processing for transferring data between the RAM 507 and the EEPROM 1102 and processing for stopping the motors M0, M1, and M2 according to the output from the voltage detector circuit 510 are further assigned to the ROM 508.

The volatile memory 507 stores data about the positions of the pointers and data about the counted time provided that the supply voltage is sufficiently high. On the other hand, the nonvolatile memory stores the data about the positions of the pointers and the data about the counted time, by making efficient use of its feature.

The starting control circuit 1101 detects oscillation and releases the system from the reset condition.

Figure 12:
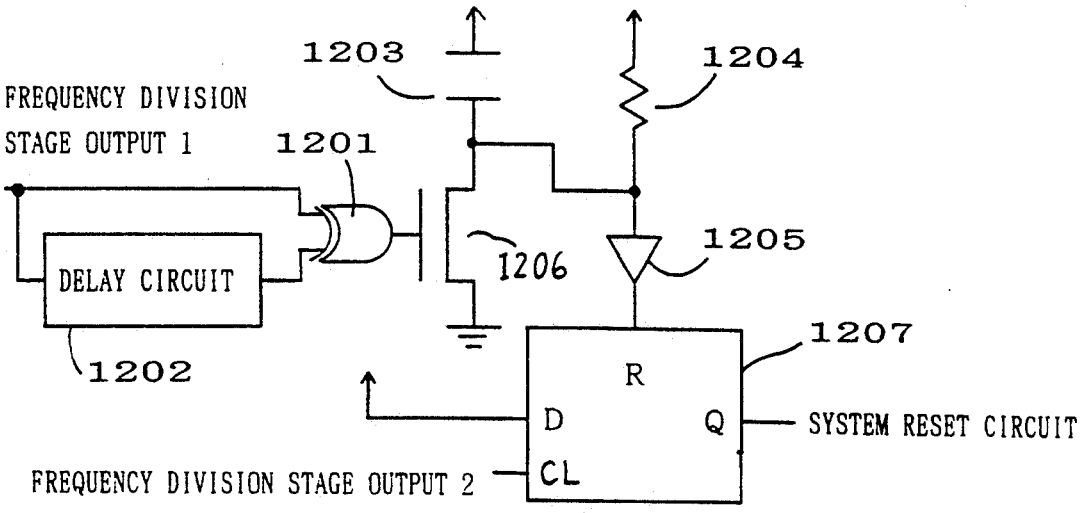
FIG. 12 is a diagram showing the structure of a starting control circuit according to the invention.

FIG. 12 shows an example of the starting control circuit 1101.

A frequency division stage output 1 signal produced from a divider 502 is applied to a gate circuit 1201. The frequency division stage output 1 signal is applied to the other input of the gate circuit 1201 via a delay circuit 1202.

If the oscillation is normal, the delay circuit 1202 operates. Under this condition, the pulse signal from the gate circuit 1201 has a pulse width equal to the delay time and is applied to a transistor 1206.

When the oscillation is started, this pulse signal electrically charges a capacitor 1203 up to ground potential, thereby releasing a flip-flop 1207 from reset condition. Then, a frequency division stage output 2 signal produced from the divider 502 releases the system from the reset condition.

Figure 15:
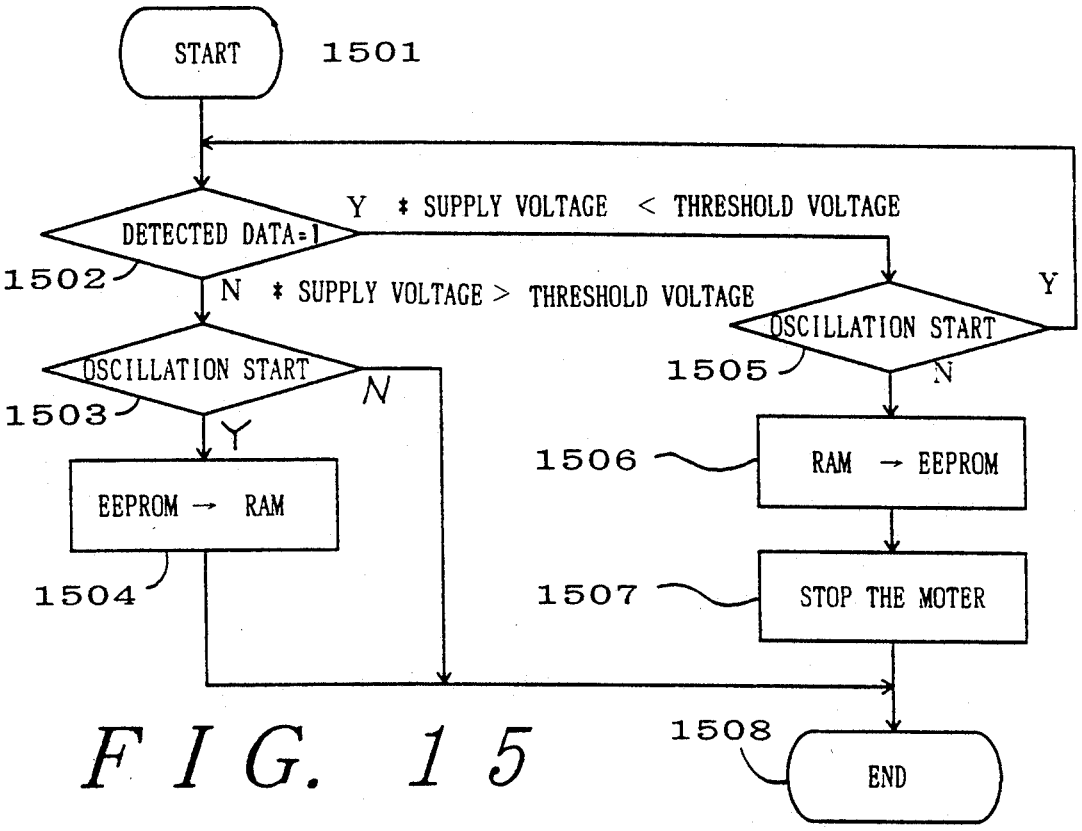
FIG. 15 is a flowchart illustrating the operations for transfer processing and drive-stopping processing according to the invention.

FIG. 15 is a flowchart illustrating the operations performed to conduct the transfer processing and the drive-stopping processing.

The supply voltage is checked by operating the voltage detector circuit 510 shown in FIG. 9. In the following description, it is assumed that only one threshold voltage exists. If the supply voltage exceeds the threshold voltage, a decision is made to see if the processing is performed when the oscillation is started. This decision is based on a flag set in the EEPROM 1102, for example. This flag is set in motor drive-stopping processing (described later). If the operation ends, the starting can be judged.

If the processing is performed when the oscillation is started, data is transferred from the EEPROM 1102 to the RAM 507. If not so, the condition is judged to be normal, and the operation is ended (steps 1501–1504, 1508).

On the other hand, if the supply voltage is below the threshold voltage and if the oscillation is not started, then data is transferred from the RAM 507 to the EEPROM 1102. Subsequently, processing for stopping the motors is executed to prevent the motor from being driven. Then, the operation is ended. To stop the motor from being driven, the pointer drive control circuit 509 may be brought to a stop or a drive-inhibiting flag may be set in the EEPROM 1102.

If the supply voltage is below the threshold voltage, and if the oscillation is started, then the supply of the electric power is judged to be abnormal. The system waits until the voltage rises.

In the present invention, if the battery is exchanged under normal voltage condition, the preservation of data about the positions of the pointers is not taken into account.

Figure 16:
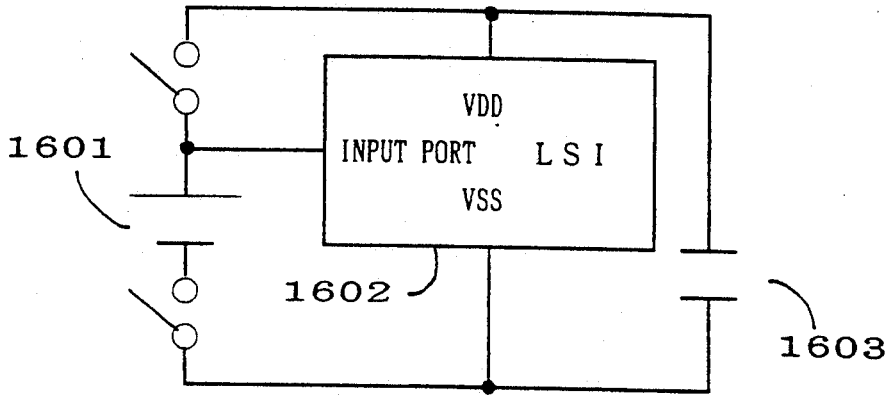
FIG. 16 is a schematic of a power supply circuit for an electronic timepiece according to the invention.

FIG. 16 is a schematic of a power supply circuit used to take a countermeasure against this. An electric battery 1601 and a capacitor 1603 are provided as a power supply for an LSI 1602. When the battery 1601 is replaced, the system can be backed up by the capacitor 1603 to some extent.

The circuit pattern is so built that when the battery 1601 is exchanged, some input port is opened, i.e., pulled down inside the LSI 1602, by removing the battery holder. Where the system is constructed in such way that when the state of any input port changes, the interrupt circuit operates to thereby operate the above-described components of the invention, if the battery 1601 is inadvertently removed, the system can cope with the situation. The relative relations between the displayed positions of the pointers and the data about the positions of the pointers in the LSI 1602 can be maintained.

As described thus far, in accordance with the present invention, the action for bringing the pointers into the reference position can be simplified, it being noted that the action must be carried out whenever the battery is exchanged. Also, this action can be dispensed with by making efficient use of the polarity discrimination means or the nonvolatile memory. Hence, the time and labor needed for after-sale service can be reduced greatly.

What is claimed is:

1. An electronic timepiece comprising:

movable pointers driveable to different positions for indicating information about time or other information;

pointer drive means for driving the pointers;

timer control means for activating the pointer drive means to provide a normal display of time;

pointer position storage means for storing position values of the pointers according to an output from the timer control means;

initial value-setting means for setting an initial value stored in the pointer position storage means;

threshold voltage value-setting means for setting a threshold voltage value corresponding to a voltage at which the components of the electronic timepiece can operate;

voltage comparator means for comparing the threshold voltage value set by the threshold voltage value-setting means with a supply voltage and providing an output;

pointer position-calculating means responsive to the output from the voltage comparator means for comparing the contents of the pointer position storage means with the initial value and providing a result of the comparison; and correcting drive control means for supplying driving pulses corresponding to the result of the comparison.

2. An electronic timepiece according to claim 1, wherein said threshold voltage value-setting means is capable of setting a plurality of threshold voltages, said electronic timepiece further comprising life display operation control means that is set into operation according to the result of a comparison with a first threshold voltage value made by the voltage comparator means for supplying peculiar driving pulses to the pointer drive means; and wherein said pointer position-calculating means is set into operation according to the result of a comparison with a second threshold voltage value made by the voltage comparator means.

3. An electronic timepiece according to claim 1, wherein said pointer drive means comprises a two-pole stepping motor having a rotor magnet; polarity discrimination means for judging the polarity of the rotor magnet; and polarity storage means for storing and outputting the result of the judgment made by the polarity discrimination means, said pointer drive means operating according to the output from the polarity storage means.

4. An electronic timepiece comprising:

movable pointers driveable to different positions for indicating information about time or other information;

pointer drive means for driving the pointers;

timer control means for activating the pointer drive means to provide a normal display of time;

pointer position storage means comprising a nonvolatile emory for storing position values of the pointers according to an output from the timer control means;

initial value-setting means for setting an initial value stored in the pointer position storage means;

threshold voltage value-setting means for setting a threshold voltage value corresponding to a voltage at which the components of the electronic timepiece can operate;

voltage comparator means for comparing the threshold voltage value set the threshold voltage-setting means with a supply voltage and providing an output; and drive-stopping means responsive to the output from the voltage comparator means for stopping the driving of the pointers by the pointer drive means.

5. An electronic timepiece comprising:

movable pointers driveable to different positions for indicating information about time or other information;

pointer drive means for driving the pointers in accordance with supplied driving pulses;

timer control means for activating the pointer drive means to provide a normal display of time;

first pointer position storage means comprising a nonvolatile memory for storing position values of the pointers according to an output from the timer control means;

initial value-setting means for setting an initial value in the first pointer position storage mans;

threshold voltage value-setting means for setting a threshold voltage value corresponding to a voltage at which the components of the electronic timepiece can operate;

voltage comparator means for comparing the threshold voltage value set by the threshold voltage value-setting means with a supply voltage and providing an output;

drive-stopping means responsive to the output from the voltage comparator means for stopping the supply of driving pulses to the pointer drive means;

transfer means which is set into operation by the drive-stopping means for transferring a part of the position values of the first pointer position storage means to a second pointer position storage means comprising a nonvolatile memory; and starting control means for detecting application of a voltage and responsive to the output from the voltage comparator means for operating the transfer means in order to transfer the contents of the second pointer position storage means to the first pointer position storage means.

6. An electric timepiece according to claim 1, further comprising:

a rechargeable energy source for driving the electronic timepiece;

energy source detecting means for detecting whether the energy source is incorporated or not, and outputting a detection signal to the pointer position-calculating means; and electric energy charging means for charging the energy source.

7. An electronic timepiece according to claim 4, further comprising:

a rechargeable energy source for driving the electronic timepiece;

energy source detecting means for detecting whether the energy source is incorporated or not, and outputting a detection signal to the drive-stopping means; and electric energy charging means for charging the energy source.

8. An electronic timepiece according to claim 5, further comprising:

a rechargeable energy source for driving the electronic timepiece;

energy source detecting means for detecting whether the energy source is incorporated or not, and outputting a detection signal to the drive-stopping means; and electric energy charging means for charging the energy source.

* * * * *